US007652644B2

(12) United States Patent
Lee et al.

(10) Patent No.: US 7,652,644 B2
(45) Date of Patent: Jan. 26, 2010

(54) ELECTRON EMISSION DISPLAY AND DRIVING METHOD

(75) Inventors: Byong-Gon Lee, Suwon-si (KR); Chun-Gyoo Lee, Suwon-si (KR); Chul Ho Lee, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 679 days.

(21) Appl. No.: 11/285,864

(22) Filed: Nov. 22, 2005

(65) Prior Publication Data

US 2006/0114189 A1 Jun. 1, 2006

(30) Foreign Application Priority Data

Nov. 30, 2004 (KR) ..... 10-2004-0099577

(51) Int. Cl.
*G09G 3/20* (2006.01)
*G09G 3/30* (2006.01)

(52) U.S. Cl. ..... 345/75.2; 345/77; 345/76

(58) Field of Classification Search ..... 345/75.2, 345/76–78, 63, 90

See application file for complete search history.

(56) References Cited

U.S. PATENT DOCUMENTS 7,268,753 B2 * 9/2007 Lee et al. ..... 345/77
7,446,738 B2 * 11/2008 Kasai ..... 345/76
2006/0114188 A1 * 6/2006 Hansen et al. ..... 345/75.2

* cited by examiner

*Primary Examiner*—Sumati Lefkowitz
*Assistant Examiner*—Charles Hicks
(74) *Attorney, Agent, or Firm*—Christie, Parker & Hale, LLP

(57) ABSTRACT

An electron emission display for improving brightness uniformity by compensating brightness deviation between respective elements. The electron emission display includes a display panel, a scan driver, a data driver, and a brightness compensator. The display panel includes a plurality of scan electrodes, a plurality of data electrodes, and a plurality of display elements respectively formed at crossing points of the scan electrodes and the data electrodes. The display elements respectively include an electron emitter. The scan driver applies a selection signal to the scan electrode. The data driver applies a data signal to the data electrode. The brightness compensator compensates brightness by changing the data signal when brightness deviation of the display elements is greater than a predetermined threshold value.

23 Claims, 10 Drawing Sheets

ELECTRON EMISSION DISPLAY AND DRIVING METHOD

CROSS-REFERENCE TO RELATED APPLICATION

This application claims priority to and the benefit of Korean Patent Application No. 10-2004-0099577 filed in the Korean Intellectual Property Office on Nov. 30, 2004, the entire content of which is incorporated herein by reference.

BACKGROUND OF THE INVENTION (a) Field of the Invention

The embodiments of the present invention relate to an electron emission display. More specifically, the embodiments relate to an electron emission display that is capable of compensating for brightness deviation.

(b) Description of the Related Art

Generally, a flat panel display (FDP) is a display device in which a seal is formed between two substrates to manufacture an airtight device and appropriate elements are arranged in the air tight device to display images. The importance of the FDP has been emphasized following the development of multimedia technologies. In response to this trend, various flat displays such as liquid crystal displays (LCDs), plasma display panels (PDPs), and electron emission displays have been developed and implemented.

In particular, because an electron emission display uses phosphorous emission caused by electron beams in a like manner to a cathode ray tube (CRT), it generates no image distortion, has low power consumption and has a high probability of forming the basis for a flat-type display that maintains the excellent characteristics of the CRT. In addition, this technology satisfies view angle, high-rate response, high resolution, fineness, and slimness criteria and accordingly, it has become the center of public attention as a next-generation display.

An electron emission display uses a cold cathode rather than a hot cathode, and such electron emission displays may be classified into field emission display (FED) devices, surface conduction emitting display (SCE) devices, and metal-insulator-metal (MIM) display devices.

The electron emission display concentrates a high electric field on an acute cathode, that is, the emitter, to emit electrons according to the quantum-mechanical tunnel effect. The electrons emitted by the emitter are accelerated by a voltage applied between the cathode electrode and the anode electrode and collide with the red, green and blue (RGB) phosphor layers formed on both the electrodes to emit light from the phosphors to display images.

However, emission of the electrons for each display element may change according to the density of the display elements, distance between the emitter and a gate electrode and an alignment of layers. That is, the emission of the electrons may change although the same signal is applied to the display elements. A difference in brightness occurs between the display elements and causes a deterioration in image quality.

SUMMARY OF THE INVENTION

The embodiments of the present invention include an electron emission display with improved display characteristics attained by compensating for brightness deviation in each display element.

The embodiments of the present invention include an electron emission display having a display panel, a scan driver, a data driver, and a brightness compensator. The display panel includes a plurality of scan electrodes to which a selection signal is sequentially applied, a plurality of data electrodes to which a data signal is applied, and a plurality of display elements each formed at the crossing point of a scan electrode and a data electrode. Each of the plurality of display elements includes an electron emitter.

The scan driver may generate and apply the selection signal to the scan electrode. The data driver may generate and apply the data signal to the data electrode.

The brightness compensator may compensate brightness by changing the data signal when brightness deviation in the plurality of display elements is greater than a predetermined threshold value.

The brightness compensator may calculate a brightness compensation value based on the brightness deviation and change the data signal by using the brightness compensation value.

The brightness compensator may compensate for brightness when the brightness deviation of two arbitrary display elements among the plurality of display elements is greater than the threshold value. The compensator may determine that the brightness deviation is less than the threshold value when an emission charge ratio obtained by dividing the amount of the emission charge for the display element that has the lower brightness by the amount of the emission charge of the display element that has the higher brightness from among the two arbitrary display elements is greater than a predetermined value.

Brightness compensation may be performed when the brightness deviation between a display element having a minimum brightness and a display element having maximum brightness among the plurality of display elements is greater than the threshold value. The compensator may determine that the brightness deviation is less than the threshold value when an emission charge ratio obtained by dividing the amount of the emission charge of the display element that has the minimum brightness by the amount of the emission charge of the display element that has the maximum brightness is greater than a predetermined value.

The brightness compensation value of a given display element may be determined by a brightness ratio of the display element that has the minimum brightness to the given display element.

The data driver may operate using a pulse width modulation (PWM) method and the data signal may be changed by multiplying the brightness compensation value by a pulse width of the data signal.

The brightness compensation value of the given display element may be determined by a value obtained by dividing the amount of the emission charge of the display element having the minimum brightness by the amount of the emission charges of the given display element.

The data driver may operate in a pulse amplitude modulation (PAM) method, and the data signal may be changed by multiplying the brightness compensation value by a voltage amplitude of the data signal.

The brightness compensation value of the given display element may be determined by a value obtained by dividing a voltage amplitude calculated based on the amount of the emission charge of the display element that has the minimum brightness by a voltage amplitude calculated based on the amount of the emission charge of the given display element.

The brightness compensation value of the given display element may be calculated for every grayscale value.

The grayscale values may be divided into a plurality of groups and the brightness compensation value of the given display element may be calculated for a predetermined grayscale value among the respective grayscale groups.

The amount of the current applied to the display elements may be measured based on the data signal applied to the data driver and the amount of the emission charge may be calculated by using the amount of the current detected.

The amount of the current applied to the display elements may be measured and the amount of the emission charge may be calculated by using the amount of the current detected.

The plurality of display elements may be divided into a plurality of groups and the brightness compensation value of an arbitrary display element may be calculated as a representative display element for the respective display element groups.

The embodiments of the present invention disclose a method for driving an electron emission display including a plurality of scan electrodes to which a selection signal is sequentially applied, a plurality of data electrodes to which a data signal is applied, a plurality of display elements respectively formed at crossing points of the scan electrodes and the data electrodes, and the plurality of display elements respectively having an electron emitter.

In the method, the amount of currents applied to each of the plurality of display elements is detected. Brightness uniformity is determined based on the amount of the currents. A brightness compensation factor for each display element is determined when the brightness uniformity is less than a predetermined value. The data signal is changed based on the brightness compensation factor.

An amount of emission charge emitted from the electron emitter of the plurality of display elements may be calculated based on the detected amount of the currents when the amount of the currents is detected and the brightness uniformity may be determined based on the amount of the emission charges.

In the detecting of the amount of the currents, the amount of the currents may be detected for the respective display elements coupled to the scan electrode while the selection signal is applied to each scan electrode.

In the detecting of the amount of the currents, the amount of the currents may be detected for the respective display elements formed coupled to the data electrode while the data signal is applied to each data electrode.

An applying time of the data signal may be determined as a compensation value based on the compensation factor and the data signal may be applied based on the compensation value. A data signal size may be determined as the compensation value based on the compensation factor and the data signal may be applied based on the compensation value.

DETAILED DESCRIPTION

Figure 1:
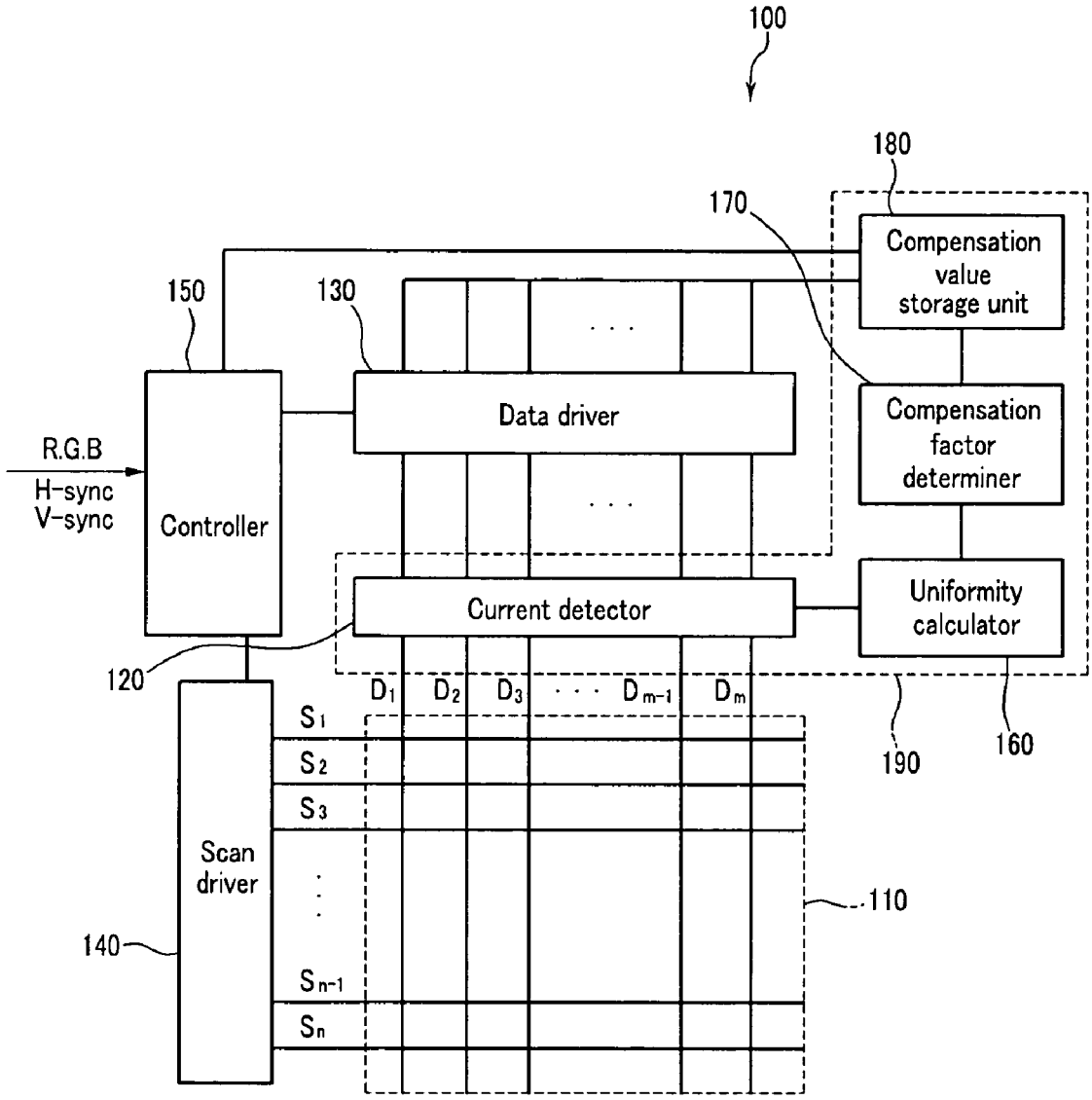
FIG. 1 is a schematic diagram of an electron emission display 100 according to one embodiment of the present invention.

An electron emission display according to a first embodiment of the present invention will be described with reference to FIG. 1 through FIG. 7. As shown in FIG. 1, the electron emission display 100 includes a display panel 110, a data driver 130 for driving data electrodes, a scan driver 140 for driving scan electrodes, a controller 150, and a brightness compensator 190.

In the display panel 110, the display elements are each formed at crossing points of the scan electrodes S1-Sn and the data electrodes D1-Dm.

Figure 2:
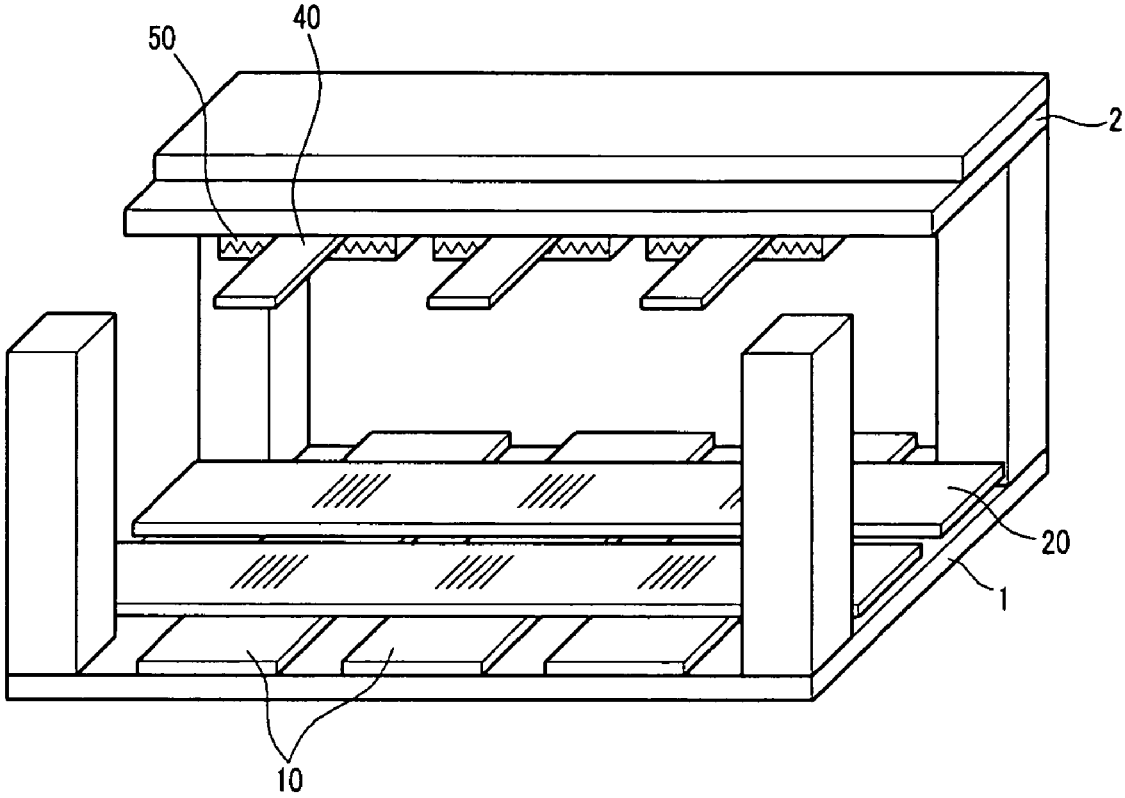
FIG. 2 is an exploded perspective view of a configuration of a display panel.
Figure 3:
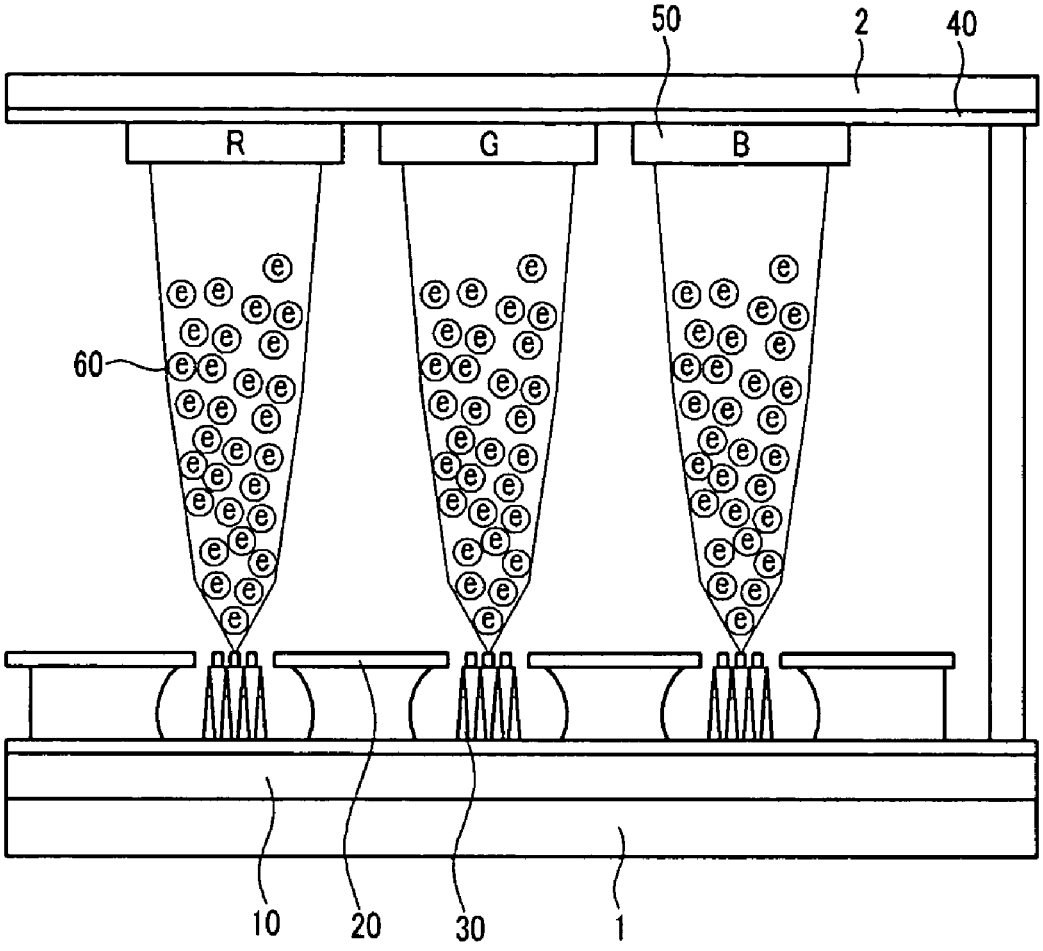
FIG. 3 is a sectional view of display elements of the display panel.

FIG. 2 shows an exploded perspective view of a configuration of the display panel 110 and FIG. 3 shows a sectional view of the display element of the display panel 110. As shown in FIG. 2 and FIG. 3, the display panel 110 includes a rear substrate 1 and a front substrate 2. An emitter 30 that is an electron emission source, a cathode electrode 10 used as the data electrode for emitting electrons 60 from the emitter 30, and a gate electrode 20 used as the scan electrode are formed on the rear substrate 1. An anode electrode 40 for attracting the electrons emitted from the emitter 30 is formed on the front substrate 2 facing the rear substrate 1 and a phosphor layer 50 including RGB phosphors is formed on the anode electrode 40 to emit light by being hit by the electrons 60.

While the cathode electrode 10 and the gate electrode 20 are respectively used as the data electrode and the scan electrode in the exemplary first embodiment of the present embodiment, the cathode electrode and the anode electrode may respectively be used as the scan electrode and the data electrode.

In addition, while the gate electrode 20 is illustrated, in FIG. 3, as a top gate type in which the gate electrode is formed on the cathode electrode, the exemplary embodiments of the present invention may be implemented using an under gate type in which the gate electrode is formed under the cathode electrode.

The display panel 110 includes n number of scan electrodes and m number of data electrodes. In the following description, "i" denotes an arbitrary number between 1 and n, and "Si" denotes a scan electrode between S1 and Sn. "j" denotes an arbitrary number between 1 and m, and "Dj" denotes a data electrode between D1 and Dm. A display element formed on a crossing point of the scan electrode Si and the data electrode Dj is denoted by "Pij." Accordingly, the display element Pij corresponds to the scan electrode Si of the gate electrode 20 and the data electrode Dj of the cathode electrode 10.

The controller 150 receives video signals red (R), green (G), and blue (B), a vertical synchronization signal V_sync, and a horizontal synchronization signal H_sync and generates a scan electrode driving signal and a data electrode driving signal. The controller 150 applies the generated signals to the scan electrode driver 140 and the data electrode driver 130, respectively. The controller 150 also generates and outputs a control signal for controlling the brightness compensator 190.

The scan driver 140 applies a driving voltage to drive the scan electrode for an appropriate scan electrodes based on the scan electrode driving signal received from the controller 150. The data driver 130 generates a data signal and applies the data signal to the appropriate data electrode based on the data electrode driving signal received from the controller 150.

When a selection signal is applied to the appropriate scan electrodes by the scan driver 140, the brightness compensator 190 measures, based on the data signal generated by the data driver 130 to be applied to the respective data electrodes Dj, the amount of current Iij for every grayscale value applied to the respective display elements, and calculates the amount of emission charge Qij for each display element based on the reference of the amount of the corresponding current Iij. That is, while a row of the display panel 110 is driven, the brightness compensator 190 repeatedly calculates the amount of the emission charges Qij by measuring the amount of the currents Iij for the display elements of every column coupled to the driven row of the display panel 110, so as to calculate the amount of the emission charges Qij by measuring the amount of the currents Iij for all the display elements Pij in the display panel 110.

Brightness compensation factors for the respective display elements are determined by comparing the calculated amount of the emission charges Qij of all the display elements Pij that are stored in the brightness compensator 190. The data driver 130 generates a data signal compensated based on the brightness compensation factors of the respective display elements and outputs the data signal.

The brightness compensator 190 includes a current detector 120, a uniformity calculator 160, a compensation factor determiner 170 and a compensation value storage unit 180.

The current detector 120 measures the data signal transmitted from the data driver 130 to the cathode electrodes of the respective display elements Pij and measures the amounts of the currents Iij of the measured data signal. The current detector 120 also calculates the amount of the charges Qij for the respective display elements based on the calculated amount of the currents Iij.

The uniformity calculator 160 determines a maximum charge max(Qij) and a minimum charge min(Qij) by comparing all the emission charges Qij and calculates brightness uniformity based on the max(Qij) and the min(Qij).

The compensation factor determiner 170 calculates a compensation factor, a time compensation factor Cij or a voltage compensation factor Dij of the respective display elements Pij based on the min(Qij).

The compensation value storage unit 180 stores a compensation value determined by the compensation factor Cij or Dij calculated by the compensation factor determiner 170 and outputs the compensation value to the data driver 130 based on the control signal of the controller 150.

An operation of the brightness compensator 190 in the electron emission display according to the first embodiment of the present invention is described with reference to FIG. 4 and FIG. 6.

The electron emission display according to the first embodiment of the present invention operates according to a pulse width modulation (PWM) method, a pulse amplitude modulation (PAM) method, or a combination of the PWM and the PAM methods. According to the PWM method, brightness and grayscale values are expressed by changing the pulse width of the data signal applied to the cathode (i.e., changing a duration for applying a predetermined voltage) to control the amount of charge emitted from the emitter. According to the PAM method, the brightness and the grayscale values are expressed by changing the amplitude of the data signal, which is applied to the cathode, to control the amount of charge emitted from the emitter while the pulse width of the data signal is maintained. In the combination method of the PWM and the PAM methods, the brightness and grayscale values are expressed by changing both the pulse width and the amplitude of the data signal to control the amount of charge emitted from the emitter.

Figure 4:
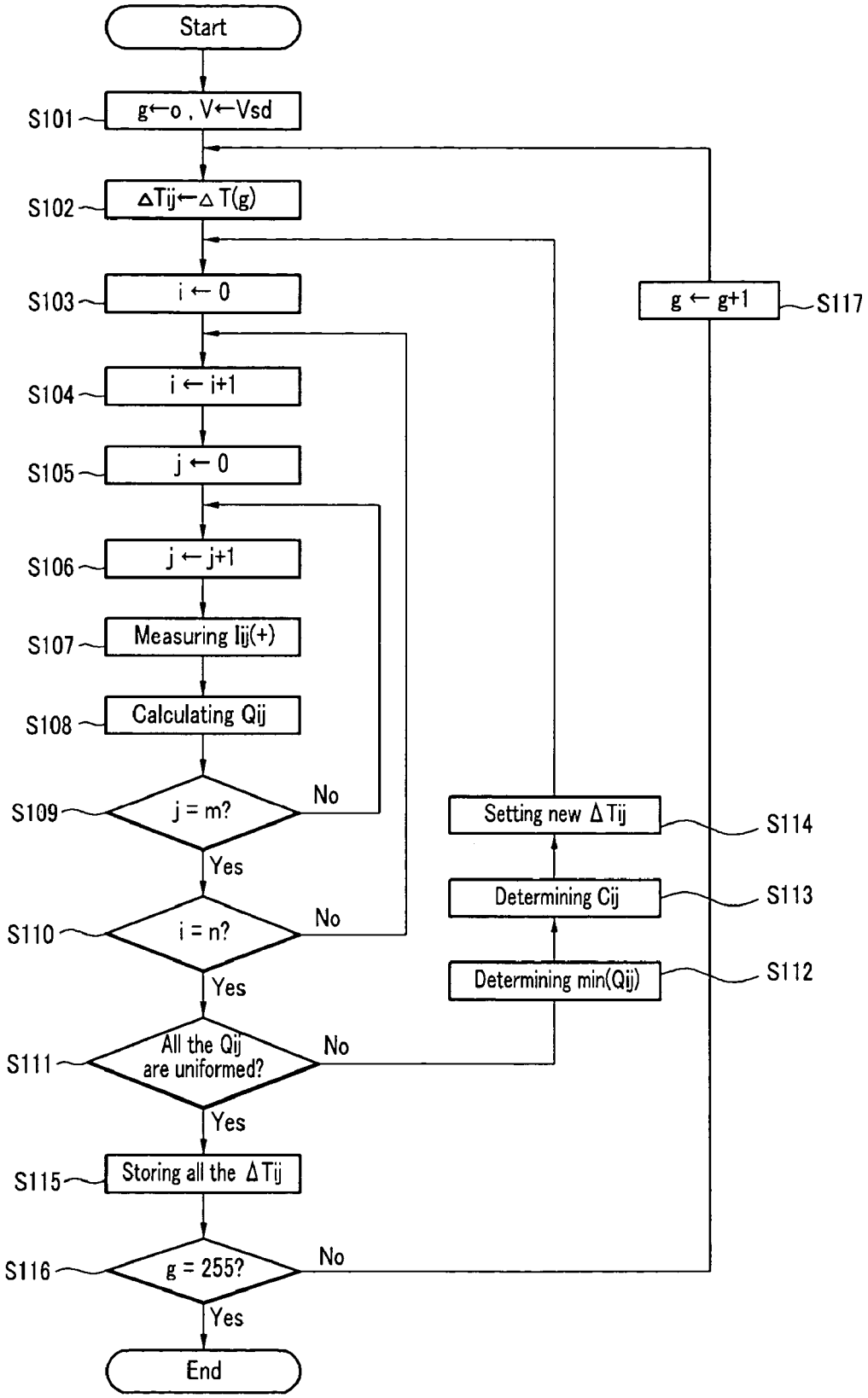
FIG. 4 is a flowchart for an operation of an electron emission display operated using the PWM method.

FIG. 4 is a flowchart of the operation of the electron emission display operated by the PWM method. In FIG. 4, the amount of the emission charge for each display element is calculated for a grayscale value of 0. The data driver 130 applies a data signal corresponding to the grayscale value of 0. Because the PWM method is used in FIG. 4, a voltage amplitude Vsd applied to the appropriate display elements based on the grayscale value is constant and the pulse width of the data signal (i.e., an applying time ΔTij) is changed. The data driver 130 applies a predetermined data voltage applying time T(0) for the grayscale value 0 in step S102.

The current detector 120 detects the emission currents Iij for each display element Pij that results from the voltage Vsd and the applying time ΔTij that are applied to the emitter of the display elements when the data driver 130 applies the data signal to the appropriate data electrodes. The current detector 120 calculates the amount of the emission charges Qij based on the emission currents Iij.

Because each of the data electrodes has a corresponding measuring integrated circuit (IC) and the scan electrodes show time differences, the emission currents Iij are measured by the currents flowing for each time period. In one embodiment, each of the measuring IC may be provided with a fine noise eliminator and an amplifier because the currents of the respective pixels may be small (e.g., several nAs to several uAs). Finishing current measurement in one frame is advantageous because the time for measuring the currents is reduced.

In one embodiment, an index i is first set to "0" in step S103 and then increased by "1" in step S104 (i.e., the selection signal is applied to the scan electrode S1). The index j is set to "0" in step S105 and then raised by "1" in step S106. Then, the emission current I11 of the display element P11 is measured in step S107, and the amount of the emission charge Q11 is calculated in step S108 based on the measured current I11. The amount of the emission charge Qij for the current Iij is calculated as shown in Equation 1.

$$Q_{ij}=\int_{T_i}^{T_{i+1}} I_{ij}(\tau)d\tau \qquad \text{[Equation 1]}$$

Ti denotes a start time for applying the selection signal to the scan electrode Si and Ti+1 denotes a start time for applying the selection signal to the scan electrode Si+1.

Using Equation 1, the amount of the emission charges Q12 to Q1m (for the case of i=1) of the display elements P12 to P1m are calculated by repeating the steps of S106 to S109. In this process, j varies from 1 to m. Then, the amount of the emission charges Qij of all the display elements Pij are calculated by repeatedly performing the steps of S103 to S109 until i reaches n in step S110.

A brightness deviation of two arbitrary display elements Pij and Pi'j' is then determined. The brightness deviation may be determined by using brightness uniformity for comparing the amount of the emission charges Qij and Qi'j' for the display elements Pij and Pi'j'. That is, as shown in Equation 2, the brightness uniformity of the display device is defined as a ratio of the amount of the emission charges Qij and Qi'j' for two arbitrary display elements Pij and Pi'j'. The brightness uniformity is determined to be acceptable when the brightness uniformity is greater than a first threshold value (e.g., above 95%) and it is determined to be unacceptable and compensation is needed when it is less than a second threshold value (e.g., below 95%).

$$\frac{Q_{ij}}{Q_{i'j'}} \times 100(\%) \geq 95\%;\ Q_{ij} \leq Q_{i'j'} \quad \text{[Equation 2]}$$

Accordingly, in step S111, it is determined whether the brightness uniformity is greater than 95% by comparing the amount of the emission charges Qij and Qi'j' for the two arbitrary display elements Pij and Pi'j'. In this example, the amount of the emission charges Qij is chosen to be less than the amount of the emission charges Qi'j'.

When the brightness uniformity for the emission charges Qij and Qi'j' is less than 95%, the compensation factor determiner 170 determines the minimum emission charge min (Qij) in step S112 out of all of the emission charges Qij. The time compensation factor Cij is calculated as shown in Equation 3 in step S113 and the predetermined applying time ΔTij is set to a new value calculated as shown in Equation 4 in step S114 by using the time compensation factor Cij.

$$C_{ij} = \frac{\min(Q_{ij})}{Q_{ij}} \quad \text{[Equation 3]}$$

$$\Delta T_{ij} \leftarrow C_{ij} \Delta T_{ij} \quad \text{[Equation 4]}$$

The steps S103 to S11 are repeated based on setting the value for each applying time ΔTij.

When the brightness uniformity is greater than 95% for every combination of the emission charges Qij and Qi'j', the overall brightness uniformity is acceptable and the pulse width timings (i.e., applying time ΔTij) corresponding to each of the display elements Pij are stored as compensation values in the compensation value storage unit 180. In the above example, the compensation values of the display elements corresponding to grayscale value 0 are stored in the compensation value storage unit 180.

In the above example, the applying time ΔTij for the data signal applied to a display element that had a large emission charge is reduced such that the amount of the emission charges for all the display elements may be close to the minimum emission charge. The amount of the emission charges for all the display elements is close to the minimum emission charge and consequently, the brightness uniformity of the display device is improved.

Next, the grayscale value is increased by one level in step S117. The steps S102 to S115 are repeated for grayscale 1. The compensation values of the display elements Pij corresponding to the grayscale value 1 are calculated and stored. By repeatedly performing the above process, the compensation values of all the display elements Pij corresponding to the 256 grayscale values are calculated and stored. The data driver 130 may generate and output the data signals for the grayscale values 0 to 255 with reference to the compensation values.

Figure 5A:
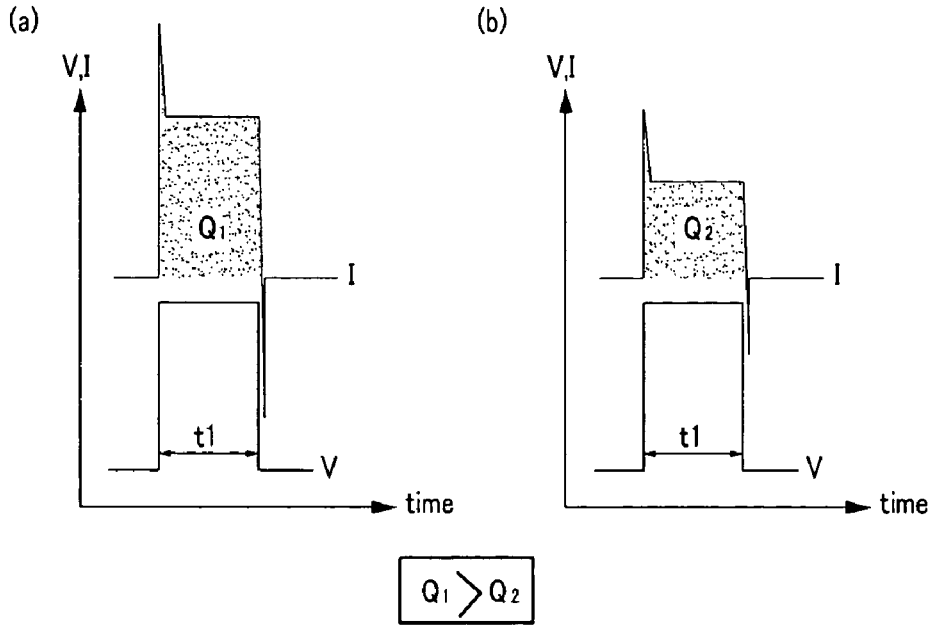
FIG. 5A is a set of related graphs of data signals and the amount of the emission charges before brightness uniformity compensation is performed as shown in FIG. 4.
Figure 5B:
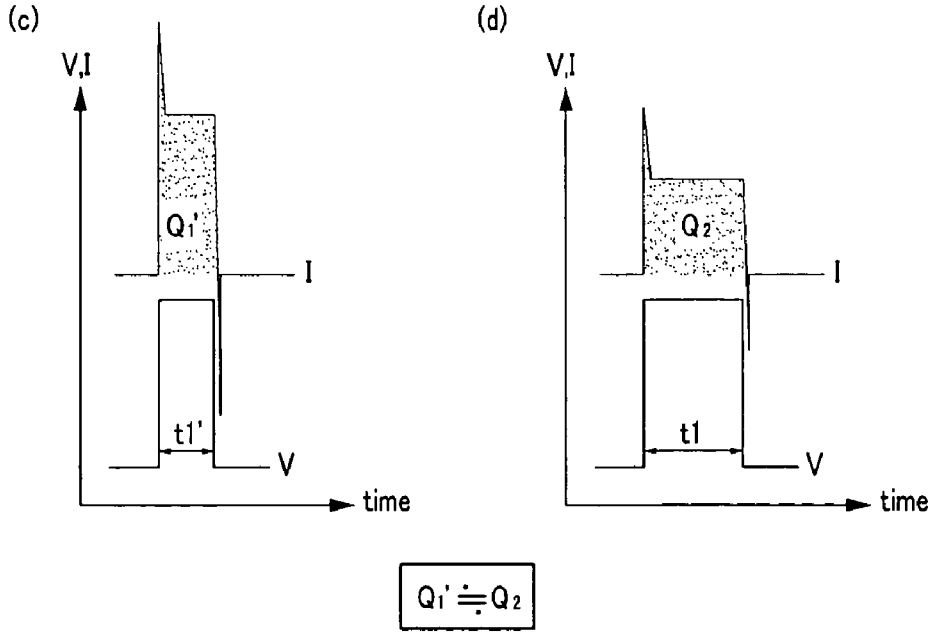
FIG. 5B is a set of related graphs of data signals and the amount of the emission charges after brightness uniformity compensation is performed as shown in FIG. 4.

In FIG. 5A, (a) and (b) show graphs for the data signal and the amount of the emission charges before the brightness uniformity compensation is performed as shown in FIG. 4, and (c) and (d) in FIG. 5B show graphs for the data signal and the amount of the emission charges after the brightness uniformity compensation is performed as shown in FIG. 4.

In FIG. 5A, (a) shows a graph for the data signal and the amount of the emission charge for the display element that has a higher luminescence and (b) shows a graph for the data signal and the amount of the emission charge for the display element that has a lower luminescence.

When a voltage is applied for the same time t1 in graphs (a) and (b), the amount of the emission charge Q1 is greater in graph (a) because the luminescence is higher and the amount of the emission charge Q2 is less in graph (b) because the luminescence is lower (Q1>Q2).

However, as shown in graph (c) in FIG. 5B, the amount of the emission charge for the display element in graph (c) is reduced from Q1 to Q1' which is close to Q2 (Q1'≈Q2) because the applying time for applying the data signal to the display element that has the higher luminescence is changed from t1 to t1' based on a compensation value stored in the compensation value storage unit 180. The data signal that is applied to the display element that has the lower luminescence for the applying time t1 stays constant with an applying time t1. As a result, the total brightness uniformity of the display device may be improved.

Figure 6:
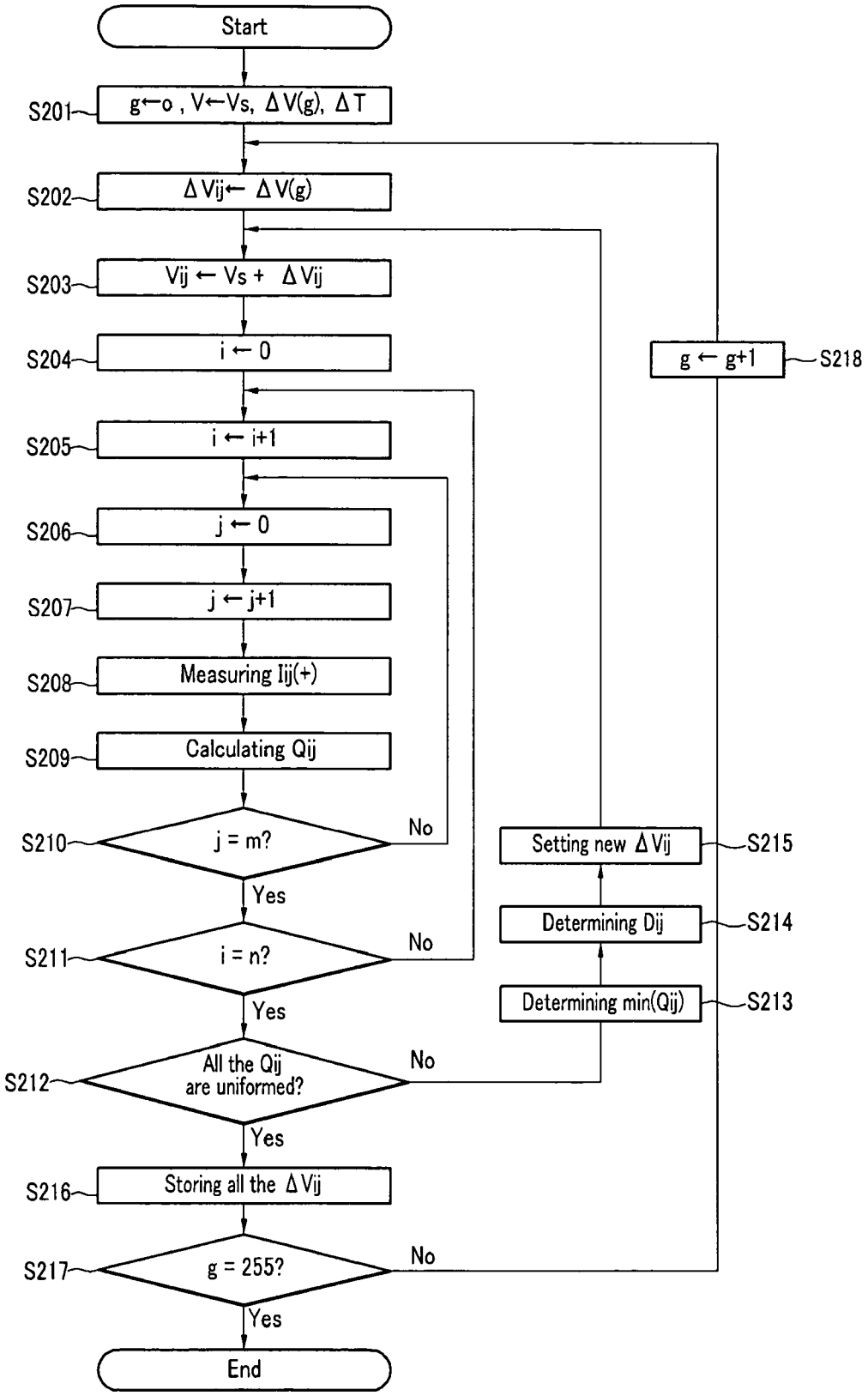
FIG. 6 is a flowchart for an operation of a brightness compensator in an electron emission display operated by the PAM method.

FIG. 6 is a flow chart for the operation of the brightness compensator 190 in an electron emission display operated using the PAM method. Because the PAM method is used in FIG. 6, the pulse width ΔTij of the driving waveform is constant and an amplitude ΔV of the driving signal is changed.

A voltage of the selection signal applied to the scan electrode (i.e., the gate electrode) is Vs, a voltage amplitude of the data signal applied to the data electrode (i.e., the cathode electrode) is ΔVij, and the pulse width is ΔT. A voltage Vij applied to the emitter is a sum of the voltage Vs applied to the gate electrode and the data voltage ΔVij applied to the cathode electrode (Vij=Vs+ΔVij) in step S203. In this example, an initial ΔVij is set to ΔV(g) which is a default voltage for the respective grayscale values in step S202.

The index i is first set to "0" in step S204 and then increased by "1" in step S205 (i.e., the selection signal is applied to the scan electrode S1). The index j is set to "0" in step S206 and then increased by "1" in step S207. Then, the emission current I11 of the display element P11 is measured in step S208 and the amount of the emission charge Q11 is calculated in step S209 based on the measured current I11. The amount of the emission charge Qij for the current Iij is calculated as described in Equation 1.

Using Equation 1, the amount of the emission charges Q12 to Q1m of the display elements P12 to P1m (for the case of i=1) are calculated by repeatedly performing steps of S207 to S209 where j varies from 2 to m. Then the steps of S205 to S211 are repeated until i reaches n from 2, at which point the amount of the emission charge Qij for all the display elements Pij are calculated.

The uniformity calculator 160 determines the brightness uniformity by comparing all the calculated amounts of the emission charges Qij. The brightness uniformity of the display device may be determined by Equation 2. In step S212, it is determined whether the brightness uniformity is greater than 95% by comparing the amount of the emission charges Qij and Qi'j' for two arbitrary display elements Pij and Pi'j'.

If the brightness uniformity of the amount of the emission charges Qij and Qi'j' is less than 95%, the compensation factor determiner 170 determines the min(Qij) in step S213 from among all the emission charges Qij. The compensation factor determiner 170 also determines a functional relation between the amount of each of the emission charges Qij and the applying voltages Vij as shown in Equation 5.

$$Q_{ij}=f(V_{ij}) \quad \text{[Equation 5]}$$

The voltage compensation factor Dij is calculated in step S214 as shown in Equation 6 by using the min(Qij) and the functional relation between the amount of each of the emission charges Qij and the applying voltages Vij.

$$D_{ij}=\frac{f^{-1}[\min(Q_{ij})]}{f^{-1}[Q_{ij}]} \quad \text{[Equation 6]}$$

Using the voltage compensation factor Dij, the predetermined voltage ΔVij is set to a new value in step S215 as shown in Equation 7.

$$\Delta V_{ij} \leftarrow D_{ij}\Delta V_{ij} \quad \text{[Equation 7]}$$

The steps S203 to S212 are repeated to calculate each of the new values of voltage ΔVij.

If the brightness uniformity is greater than 95% after all the emission charges Qij and Qi'j' are compared, the brightness uniformity is acceptable and the voltages ΔVij corresponding to the respective display elements Pij are stored as compensation values in the compensation value storage unit 180. In the above example, the compensation values of the display elements corresponding to grayscale value 0 are stored in the compensation value storage unit 180.

In the above example, the voltage amplitude of the data signal applied to the display element that has a larger emission charge is reduced such that the amount of the emission charges for all display elements may be adjusted to be close to the minimum emission charge. The amount of the emission charges for all the display elements is close to the minimum emission charge and as a result, the brightness uniformity of the display device is improved.

Figure 7A:
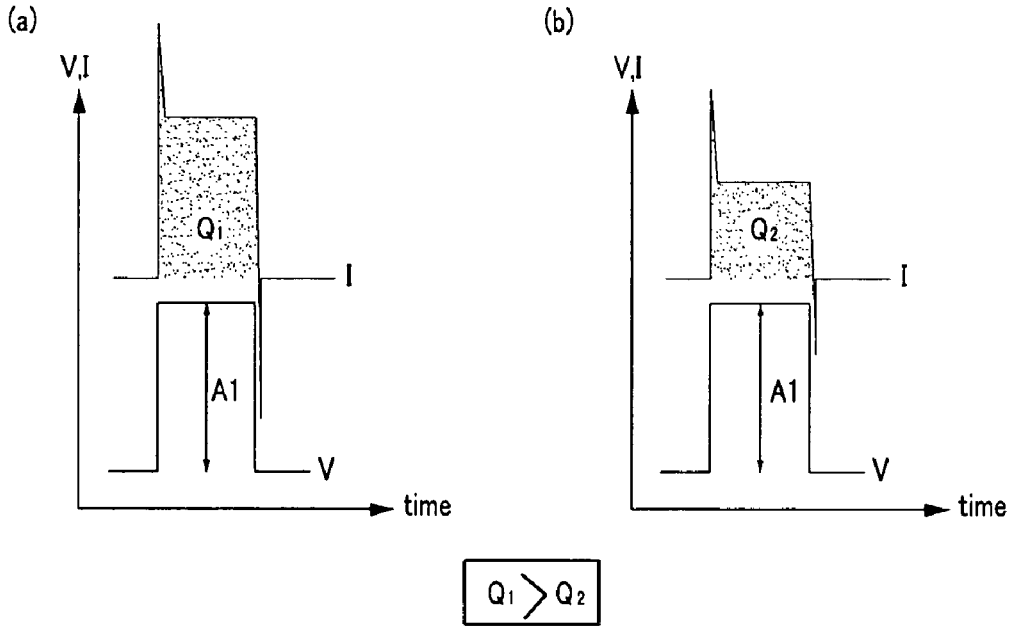
FIG. 7A is a set of related graphs of data signals and the amount of the emission charges before brightness uniformity compensation is performed as shown in FIG. 6.
Figure 7B:
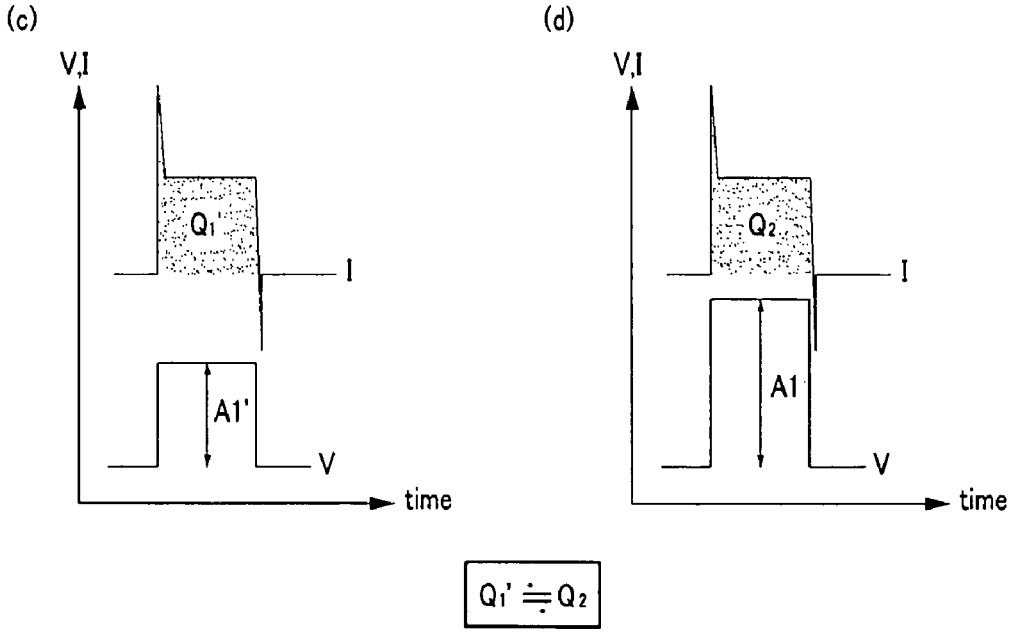
FIG. 7B is a set of related graphs of data signals and the amount of the emission charges after brightness uniformity compensation is performed as shown in FIG. 6.

In FIG. 7A, (a) and (b) show graphs for the data signal and the amount of the emission charge before the brightness uniformity compensation is performed according to the embodiment of the process shown in FIG. 6. In FIG. 7B, (c) and (d) show graphs for the data signal and the amount of the emission charges after the brightness uniformity compensation is performed according to the embodiment of the process shown in FIG. 6.

Graph (a) in FIG. 7A shows the data signal and the amount of the emission charge of the display element that has the higher luminescence. Graph (b) shows the data signal and the amount of the emission charge for the display element having the lower luminescence.

When the same voltage A1 is applied in graphs (a) and (b), the amount of the emission charge Q1 is greater in graph (a) because the luminescence is higher and the amount of the emission charge Q2 is less in graph (b) because the luminescence is lower (Q1>Q2).

However, as shown in graphs (c) and (d) in FIG. 7B, the amount of the emission charge for the display element in graph (c) is reduced from Q1 to Q1' which is close to Q2 (Q1'≈Q2) because the voltage amplitude of the data signal for the display element having the higher luminescence is changed from A1 to A1' based on the compensation value stored in the compensation value storage unit 180. The voltage A1 that is applied to the display element having the lower luminescence remains constant. As a result the total brightness uniformity of the display device may be improved.

An electron emission display according to a second embodiment of the present invention will now be described. While the brightness uniformity is determined by comparing the amount of the emission charges Qij for all the display elements Pij to each other in the first exemplary embodiment of the present invention, the brightness uniformity may be determined by comparing the maximum amount of the emission charges max (Qij) and the minimum amount of the emission charges min (Qij).

In step S11 in FIG. 4 according to the second embodiment, the max Qij and the min Qij are determined from among the emission charges Qij and the total brightness uniformity of the display panel 110 is determined as shown in Equation 8. The step S112 is performed when the determined brightness uniformity is less than a predetermined threshold value (e.g. below 95%), because the brightness of the display panel 110 is not uniform. The step S115 is performed when the brightness uniformity is greater than 95%.

$$\frac{\min(Q_{ij})}{\max(Q_{ij})}\times 100(\%) \geq 95\% \quad \text{[Equation 8]}$$

In step S212 in FIG. 6, the max Qij and the min Qij are determined from among all of the emission charges Qij and the total brightness uniformity of the display panel 110 is determined as shown in Equation 8. The step S213 is performed when the determined brightness uniformity is less than the predetermined threshold value (e.g., below 95%), because the brightness of the display panel 10 is not uniform. The step S216 is performed when the brightness uniformity is greater than 95%.

The electron emission display according to the second exemplary embodiment of the present invention has the same effect as the electron emission display according to the first exemplary embodiment of the present invention. When the currents detected from an output terminal of the data driver 130 are transmitted to the display element without any leakage or short circuit and therefore the detected currents are in proportion to the emission currents of the anode electrode, the electron emission display 100 according to the first and second exemplary embodiments of the present invention may operate normally or as intended. However, when the detected current is out of proportion to the emission current because a leakage or short-circuit is caused by a poor quality of the data electrode, the compensation factor is inaccurately calculated and the brightness uniformity compensation effect may be reduced.

An electron emission display for solving the this problem is presented as a third exemplary embodiment of the present invention described with reference to FIG. 8 to FIG. 10.

Figure 8:
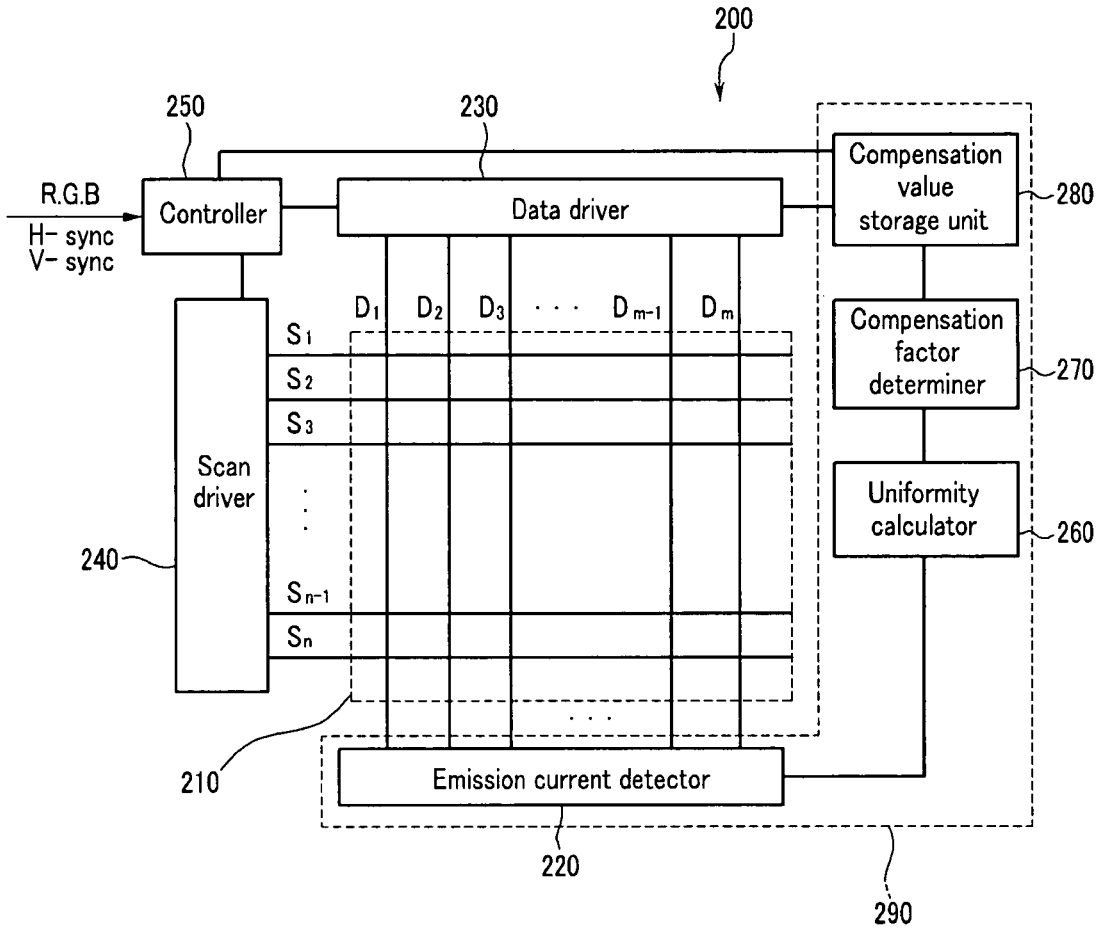
FIG. 8 is a schematic diagram of an electron emission display according to an exemplary embodiment of the present invention.

FIG. 8 shows a schematic diagram of the electron emission display 200 according to the third exemplary embodiment of the present invention. The electron emission display 200 according to the third exemplary embodiment detects the emission current from the electrodes at the emitter of the display element, which is different from the electron emission display 100 according to the first exemplary embodiment.

The electron emission display 200 according to the third exemplary embodiment includes a display panel 210, a data driver 230 for driving data electrodes, a scan driver 240 for driving scan electrodes, a controller 250, and a brightness compensator 290.

Configuration and operation of the display panel 210, the data driver 230, the scan driver 240, and the controller 250 are similar to those of the display panel 110, the data driver 130, the scan driver 140, and the controller 150, and therefore no further description will be provided.

While a data signal is applied to a data electrode D1, the brightness compensator 290 measures the amount of emission currents I11 to In1 that are transmitted to respective emitters of display elements P11 to Pn1 by sequentially applying a selection signal to the scan electrodes S1 to Sn and calculating the amount of emission charge Qij for each of the display elements based on the amount of the respective emission currents Iij.

That is, when a column of the display panel 210 is driven, the brightness compensator 290 repeatedly calculates the amount of the emission charge Qij by measuring the current Iij of the display elements in every row coupled to every column, and measures the amount of the current Iij for all the display elements of the display panel 210 by repeatedly calculating the amount of the emission charges Qij. The brightness compensator 290 determines and stores the brightness compensation factor for each of the display elements by comparing the calculated amounts of the emission charges Qij for all the display elements Pij. The data driver 230 generates and outputs the compensated data signal based on the brightness compensation factors of the respective display elements.

The brightness compensator 290 includes an emission current detector 220, a uniformity calculator 260, a compensation factor determiner 270, and a compensation value storage unit 280.

The emission current detector 220 measures the data signal transmitted from the data driver 230 to the anode electrodes of the display elements Pij, and measures the amount of the emission currents Iij of each data signal. The current detector 220 also calculates the amount of the emission charge Qij for each display element based on the measured amount of the emission current Iij.

The uniformity calculator 260 determines the max(Qij) and the min(Qij) by comparing all the amounts of the emission charges Qij and calculates the brightness uniformity based on the max(Qij) and the min(Qij).

The compensation factor determiner 270 calculates the compensation factors Cij and Dij of the respective display elements Pij based on the min(Qij).

The compensation value storage unit 280 stores compensation values determined using the compensation factor Cij, which is calculated by the compensation factor determiner 270 and outputs the compensation values to the data driver 230 based on the control signal of the controller 250.

Figure 9:
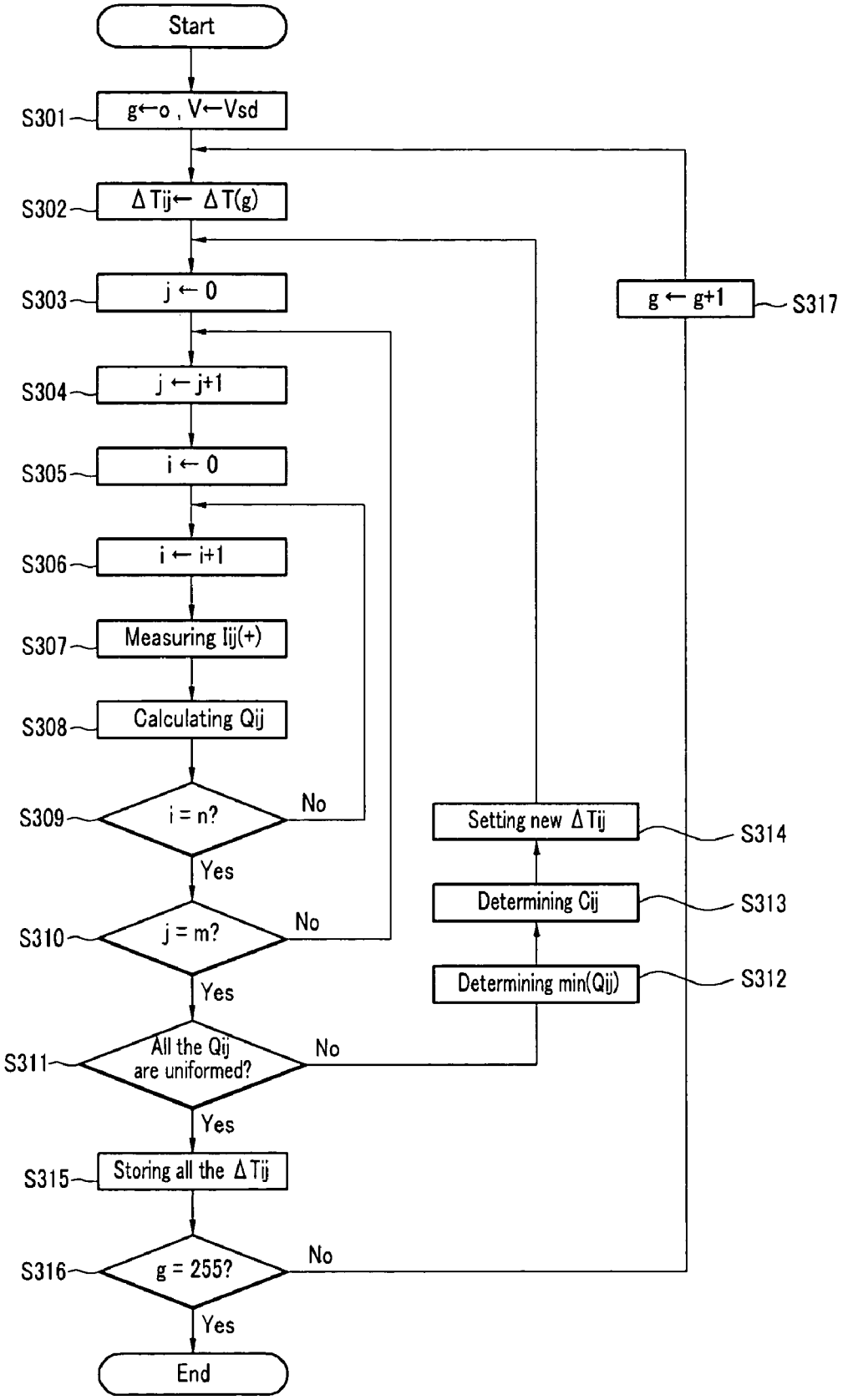
FIG. 9 is a flowchart for describing an operation of a brightness compensator in the electron emission display operated in the PWM method.

FIG. 9 is a flowchart for describing an operation of the brightness compensator 290 of the electron emission display operated using the PWM method.

Steps in FIG. 9 are similar to those in FIG. 4. While the amount of the currents of the display elements in every column coupled in a row are calculated in FIG. 4, the amount of the currents of the display elements in every row coupled in a column are calculated in FIG. 9. That is, the amount of the current for each of the display elements P11 to P1m are measured in FIG. 4. The display elements P11 and P1m are display elements in a first row coupled to the scan electrode S1. Then, the amount of the currents for each of the display elements P21 to P2m are measured. The display elements P21 to P2m are display elements of a second row coupled to the scan electrode S2. In contrast, the amount of the current for each of the display elements P11 to Pn1 are measured in FIG. 9. The display elements P11 to Pn1 are display elements in a first column coupled to the data electrode D1. Then, the amount of the current for each of the display elements P12 to Pn2 are measured. The display elements P12 to Pn2 are display elements of a second column coupled to the data electrode D2.

The amount of the emission charge for each display element is calculated for grayscale value 0. The data driver 230 applies a data signal corresponding to the grayscale value 0. Because the PWM method is used in FIG. 9, the voltage Vsd applied to each display element based on the grayscale value is constant and the pulse width of the data signal (i.e., the applying time ΔTij) is changed. The data driver 230 applies a predetermined data voltage applying time T(0) for the grayscale 0 in step S302.

The current detector 220 detects the emission current Iij of each display elements Pij based on the voltage Vsd and the applying time ΔTij applied to the emitter of the display element by the data signal that is applied to the respective data electrodes by the data driver 230. First, the index j is set to "0" in step S303, and then increased to "1" in step S304 (i.e., the data signal is applied to the data electrode D1). The index i is set to "0" in step S305 and then increased to "1" in step S306. Then, the emission current I11 of the display element P11 is measured in step S307 and the amount of the emission charge Q11 is calculated in step S308 based on the measured current I11 as shown in Equation 1.

When j is 1, the amount of the emission charges $Q_{21}$ to $Q_n$1 of the display elements $P_{21}$ to $P_{n1}$ are calculated by repeating steps S306 to S309. During this process, i varies from 2 to n. By repeating he steps of S303 to S309 until j reaches m in step S310, the amount of the emission charge $Q_{ij}$ for all the display elements $P_{ij}$ are calculated. Steps S311 to S317 are similar to the steps S11 to S117, and no further description for the steps S311 to S317 is provided.

When the brightness uniformity is greater than 95% for every combination of the emission charges $Q_{ij}$ and $Q_{i'j'}$, the brightness uniformity is acceptable and therefore the pulse widths (i.e., applying time $\Delta T_{ij}$) corresponding to the respective display elements $P_{ij}$ are stored as compensation values in the compensation value storage unit 280. In the above example process, the compensation values of the display elements corresponding to grayscale value 0 are stored in the compensation value storage unit 280. The applying time of the data signal is determined based on the stored compensation value.

In the above example process, the applying time $\Delta T_{ij}$ of the data signal that is applied to the display element that has the larger emission charge is reduced such that the amount of the charge for all of the display elements may be close to the minimum emission charges. As a result, the amount of the emission charges for all of the display elements is close to the minimum emission charge and therefore the brightness uniformity of the display device is improved.

Figure 10:
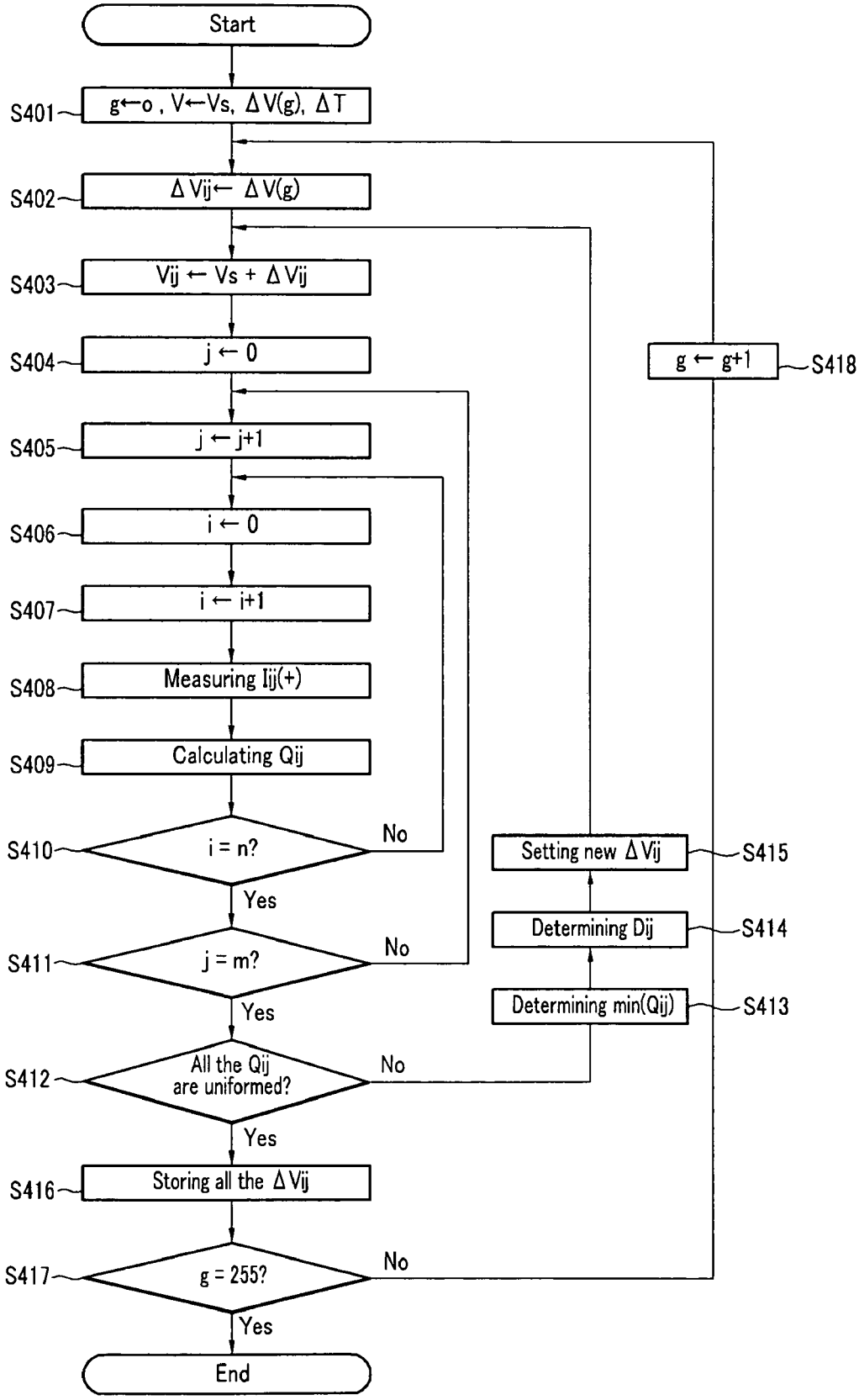
FIG. 10 is a flowchart for an operation of a brightness compensator of the electron emission display operated in the PAM method.

FIG. 10 is a flowchart for an operation of the brightness compensator 290 of the electron emission display operated using the PAM method. Because the PAM method is used in FIG. 10, the pulse width ΔTij of the driving waveform is constant and the amplitude ΔV of the driving signal is modulated.

The voltage of the selection signal applied to the scan electrode (i.e., the gate electrode) is Vs, the amplitude of the data signal applied to the data electrode (i.e., the cathode electrode) is ΔVij, and the pulse width is ΔT. A voltage Vij applied to the emitter is a sum of the voltage Vs applied to the gate electrode and the data voltage ΔVij applied to the cathode electrode (Vij=Vs+ΔVij) in step S403. In this example, for each grayscale value, an initial ΔVij is set to ΔV(g) which is a default voltage in step S402.

First, the index j is set to "0" in step S404 and then increased by "1" in step S405. The index i is set to "0" in step S406 and then increased by "1" in step S407. Then, the emission current I11 of the display element P11 is measured in step S408 and the amount of the emission charge Q11 is calculated in step S409 based on the measured current I11. The amount of the emission charge Qij for the current Iij is calculated as shown in Equation 1.

Using Equation 1, the amount of the emission charges Q21 to Qn1 of the display elements P21 to Pn1 (for the case of j=1) are calculated by repeating steps S407 to S409. During this process, i varies from 2 to n. By repeating the steps of S405 to S410 until j reaches m from 2 in step S411, the amount of the emission charge Qij for all of the display elements Pij are calculated.

The uniformity calculator 260 determines the brightness uniformity by comparing the calculated amount of the emission charges Qij in step S412. The brightness uniformity of the display device may be determined by Equation 2. Steps S413 to S418 are similar to the steps S213 to S218 in FIG. 6, and no further description for the steps S413 to S418 is provided.

When the brightness uniformity is greater than 95% for every combination of the emission charges Qij and Qi'j', the brightness uniformity is acceptable, and the pulse widths (i.e., applying time ΔTij) corresponding to the respective display elements Pij are stored as compensation values in the compensation value storage unit 280. In the above example process, the compensation values of the display elements corresponding to grayscale value 0 are stored in the compensation value storage unit 280.

In the above example process, the voltage of the data signal applied to the display element that has a larger emission charge is reduced such that the amount of the emission charge for every display element may be close to the minimum emission charge. As a result, the amount of the emission charge for all the display elements is close to the minimum emission charges and therefore the brightness uniformity of the display device is improved.

As described, even though the data electrode has a poor quality because the electron emission display 200 according to the third exemplary embodiment of the present invention detects the emission current from the anode terminal of the display element, more accurate brightness compensation factors may be calculated. Accordingly, the brightness uniformity may effectively be compensated.

An electron emission display according to a fourth exemplary embodiment of the present invention. The brightness uniformity is determined by comparing the amount of the emission charges Qij of the display elements Pij to each other in the third exemplary embodiment of the present invention, the brightness uniformity may be determined by comparing the maximum charge max (Qij) and the minimum emission charge min (Qij) according to the second exemplary embodiment of the present invention.

In step S311 in FIG. 9, the max (Qij) and the min (Qij) are determined from among the emission charges Qij and the total brightness uniformity of the display panel 210 is determined as shown in Equation 8. The step S312 is performed when the determined brightness uniformity is less than the predetermined threshold value (e.g. below 95%) since the brightness of the display panel 210 is not uniform. The step S315 is performed when the brightness uniformity is greater than 95%.

In step S412 in FIG. 10, the max (Qij) and the min (Qij) are determined from among the emission charges Qij, and the total brightness uniformity of the display panel 210 is determined as shown in Equation 8. The step S413 is performed when the determined brightness uniformity is less than the predetermined threshold value (e.g., below 95%) because the brightness of the display panel 10 is not uniform. The step S416 is performed when the brightness uniformity is greater than 95%.

The electron emission display according to the fourth exemplary embodiment of the present invention has the same effect as the electron emission display according to the third exemplary embodiment of the present invention.

According to the first to fourth exemplary embodiments of the present invention, the brightness compensation is performed by calculating the amount of the emission charge Qij for all the display elements Pij for each grayscale value. The driving speed may be reduced because operations performed by the brightness compensator are increased. However, the brightness compensation is more accurately performed because the brightness of all the display elements is considered. Because neighboring display elements generally have the same characteristics as each other, the brightness compensation may be performed by dividing the display panel into a plurality of groups and using a representative display element of the respective groups. In a like manner, without calculating the amount of the emission charge of a display element for every grayscale value, the grayscale values may be divided into a plurality of groups and the emission charges for the display elements are calculated for a representative grayscale value from each groups. The brightness compensation of all the display elements may be performed based on the amount of the emission charge for the representative grayscale values. When the representative display element or the representative grayscale is used for the brightness compensation, the driving speed of the display device may be increased because the number of operations performed by the brightness compensator is reduced, but the accuracy of the brightness compensation may be reduced.

According to the exemplary embodiments of the present invention, the total brightness uniformity of the display panel may be improved by reducing the amount of the emission charges for all the display elements based on the display element having the lowest luminescence with reference to the detected currents.

While this invention has been described in connection with exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. An electron emission display comprising:

a display panel having a plurality of scan electrodes to which selection signals are sequentially applied, a plurality of data electrodes to which data signals are applied, and a plurality of display elements respectively formed at crossing points of the scan electrodes and the data electrodes, the plurality of display elements each having an electron emitter;

a scan driver for generating and applying the selection signals to the scan electrodes;

a data driver for generating and applying the data signals to the data electrodes; and a brightness compensator coupled to the data driver for compensating brightness by separately calculating brightness compensation values for every gray level and for changing the data signals in accordance with the brightness compensation values when a brightness deviation of the plurality of display elements is greater than a predetermined threshold value.

2. The electron emission display of claim 1, wherein the brightness compensator calculates the brightness compensation values based on the brightness deviation and changes the data signals by utilizing the brightness compensation values.

3. The electron emission display of claim 2, wherein the brightness compensator compensates brightness when brightness deviation of two arbitrary display elements among the plurality of display elements is greater than the predetermined threshold value.

4. The electron emission display of claim 3, wherein the brightness compensator determines that the brightness deviation is less than the predetermined threshold value if an emission charge ratio obtained by dividing an amount of emission charge of a display element having a lower brightness by an amount of emission charge of a display element having a higher brightness among the two arbitrary display elements is greater than a predetermined value.

5. The electron emission display of claim 2, wherein the brightness compensation is performed when the brightness deviation between a display element having minimum brightness and a display element having maximum brightness among the plurality of display elements is greater than the predetermined threshold value.

6. The electron emission display of claim 5, wherein the brightness compensator determines that the brightness deviation is less than the predetermined threshold value if an emission charge ratio obtained by dividing an amount of emission charge of a display element having the minimum brightness by an amount of emission charge of a display element having the maximum brightness is greater than a predetermined value.

7. The electron emission display of claim 2, wherein the brightness compensation values of a first display element are determined by a brightness ratio of a display element having a minimum brightness to the first display element.

8. The electron emission display of claim 7, wherein the data driver operates by utilizing a pulse width modulation method, and wherein the data signals are changed by multiplying the brightness compensation values by a pulse width of the data signal.

9. The electron emission display of claim 8, wherein the brightness compensation values of the first display element are determined by utilizing a value obtained by dividing an amount of emission charge of a display element having the minimum brightness by an amount of emission charge of the first display element.

10. The electron emission display of claim 7, wherein the data driver operates by utilizing a pulse amplitude modulation method, and wherein the data signals are changed by multiplying the brightness compensation values by voltage amplitudes of the data signals.

11. The electron emission display of claim 10, wherein the brightness compensation values of the first display element are determined by utilizing a value obtained by dividing a voltage amplitude calculated based on an amount of emission charge for the display element having the minimum brightness by a voltage amplitude calculated based on the amount of emission charge of the first display element.

12. The electron emission display of claim 1, wherein gray levels are divided into a plurality of groups and the brightness compensation values are calculated for a predetermined gray level for each of the plurality of groups.

13. The electron emission display of claim 4, wherein an amount of current applied to a display element is measured based on the data signals applied from the data driver and an amount of emission charge is calculated by utilizing the amount of the current applied to the display element.

14. The electron emission display of claim 4, wherein an amount of current applied to a display element is measured and an amount of emission charge is calculated by utilizing the amount of the current.

15. The electron emission display of claim 2, wherein the plurality of display elements are divided into a plurality of groups and the brightness compensation values of a first display element are calculated as a representative display element for a corresponding group of the plurality of groups.

16. A method for driving an electron emission display having a plurality of scan electrodes to which selection signals are sequentially applied, a plurality of data electrodes to which data signals are applied, and a plurality of display elements respectively formed at crossing points of the scan electrodes and the data electrodes, the plurality of display elements including an electron emitter, the method comprising:

detecting an amount of current applied to each of the plurality of display elements;

determining brightness uniformity based on the amount of the current;

determining brightness compensation factors separately for every gray level for each display element if the brightness uniformity is less than a predetermined value; and changing the data signals based on the brightness compensation factors.

17. The method of claim 16, further comprising:

calculating an amount of emission charge emitted from each electron emitter of the plurality of display elements based on detected amounts of current for each of the plurality of display elements, wherein the determining of the brightness uniformity determines the brightness uniformity based on the amount of the emission charge.

18. The method of claim 16, wherein the detecting of the amount of current includes detecting the amount of current for each display element coupled to a one of the plurality of scan electrodes while the selection signal is applied to the one of the plurality of scan electrodes.

19. The method of claim 16, wherein the detecting of the amount of current includes detecting the amount of current for respective display elements coupled to a one of the plurality of data electrodes while the data signal is applied to the one of the plurality of data electrodes.

20. The method of claim 16, further comprising:

determining compensation values for application times of the data signals based on the brightness compensation factors, wherein the data signals are applied based on the compensation values.

21. The method of claim 16, further comprising:

determining compensation values for data signal amplitudes based on the brightness compensation factors, wherein the data signals are applied based on the compensation values.

22. A device comprising:

a current detector for detecting an amount of current for an electrode in an electron emission display panel;

a uniformity calculator coupled to the current detector, the uniformity calculator for determining a brightness deviation for a display element; and a compensation factor determiner coupled to the uniformity calculator, the compensation factor determiner for separately determining brightness compensation values for every gray level when the brightness deviation is greater than a predetermined threshold value.

23. The device of claim 22, further comprising:

a compensation value storage unit coupled to the compensation factor determiner, the compensation value storage unit for storing the brightness compensation values.

* * * * *